US009855509B1

(12) United States Patent
Hsu

(10) Patent No.: US 9,855,509 B1
(45) Date of Patent: Jan. 2, 2018

(54) TOY

(71) Applicant: Dongguan Weikuan Plastic Products Co., Ltd., Dongguan (CN)

(72) Inventor: Ta-Wei Hsu, Dongguan (CN)

(73) Assignee: DONGGUAN WEIKUAN PLASTIC PRODUCTS CO., LTD., Dongguan, Guangdong (CN)

( * ) Notice: Subject to any disclaimer, the term of this patent is extended or adjusted under 35 U.S.C. 154(b) by 0 days.

(21) Appl. No.: 15/367,142

(22) Filed: Dec. 1, 2016

(51) Int. Cl.
*A63H 13/00* (2006.01)
*A63H 3/06* (2006.01)
*A63H 3/20* (2006.01)

(52) U.S. Cl.
CPC ..... *A63H 3/06* (2013.01); *A63H 3/20* (2013.01)

(58) Field of Classification Search
CPC ... A63H 3/06; A63H 3/20; A63H 3/40; A63H 13/005; A63H 3/18; A63H 13/00
USPC ..... 446/199, 308, 309, 310, 311, 312, 314, 446/315
See application file for complete search history.

(56) References Cited

U.S. PATENT DOCUMENTS 2,618,894 A * 11/1952 Nudelman ..... A63H 3/48 446/190
2,701,934 A * 2/1955 Auzin ..... A63H 3/40 446/310
3,032,921 A * 5/1962 Greene ..... A63H 3/48 446/190
3,093,925 A * 6/1963 Greene ..... A63H 33/28 446/18
3,159,935 A * 12/1964 Rubens ..... G09F 11/23 40/415
3,896,584 A * 7/1975 Terzian ..... A63H 3/28 446/192
4,207,704 A * 6/1980 Akiyama ..... G09B 23/36 360/79
4,262,444 A * 4/1981 Cooper ..... A63H 3/20 446/185
7,614,171 B2 * 11/2009 Hsu ..... F04D 27/00 40/412
2007/0234604 A1 * 10/2007 Hsu ..... G09F 15/0025 40/412

* cited by examiner

*Primary Examiner* — Vishu Mendiratta
(74) *Attorney, Agent, or Firm* — Leong C. Lei

(57) ABSTRACT

A toy includes a hollow soft plastic shell deformable by means of squeezing, first modeling piece configured on the hollow soft plastic shell and second modeling piece coupled pivotally to the first modeling piece; the hollow soft plastic shell has a top wall arched downward to form an accommodation concave chamber. The present invention is novel in structure, interesting, energetic and easy to be operated and controlled. In addition the toy of the present invention is easy to be produced and manufactured because of the simple structure thereof, very stable in use, and suitable for the promotion, production and application so as to meet entertainment, teaching, trick or other needs.

9 Claims, 2 Drawing Sheets

TOY

(a) TECHNICAL FIELD OF THE INVENTION

The present invention relates to a toy, and more particularly to a soft plastic toy.

(b) DESCRIPTION OF THE PRIOR ART

Soft plastic toys are generally felt more comfortable and have a rich variety of shapes. But, current soft plastic toys have been fewer breakthroughs on structure and play such that it is difficult for them to meet people's pursuit to the novelty and interest.

SUMMARY OF THE INVENTION

To better meet people's needs for soft plastic toys, and overcome the deficits mentioned above, the present invention is proposed.

The main object of the present invention is to provide a toy, being novel in structure, interesting, energetic and easy to be operated and controlled, and in addition, being easy to be produced and manufactured because of the simple structure thereof, very stable in use, and suitable for the promotion, production and application so as to meet entertainment, teaching, trick or other needs.

To achieve the object mentioned above, the present invention proposes a toy, including a hollow soft plastic shell deformable by means of squeezing, a first modeling piece configured on the hollow soft plastic shell, and a second modeling piece coupled pivotally to the first modeling piece, the second modeling piece rotatable up and down relatively to the first modeling piece, wherein an air-filled chamber is defined inside the hollow soft plastic shell, an air filling hole in communication with the air-filled chamber is opened on the hollow soft plastic shell, and a sealing plug is inserted in the air filling hole; the hollow soft plastic shell has a top wall arched downward, an accommodation concave chamber is formed on a upper side of the top wall of the hollow soft plastic shell, and a blocking portion adapted to limit the second modeling piece is further configured on the hollow soft plastic shell; the first modeling piece is in connection with top wall; in a normal state, the top wall is arched downward, a bottom of the first modeling piece is hidden in the accommodation concave chamber, the second modeling piece is subject to a support force facing toward the first modeling piece exerted by the blocking portion, and the second modeling piece is closed with the first modeling piece; in a squeeze state, the top wall is ached upward, the second modeling piece is exposed upward together with the first modeling piece, the second modeling piece is not supported by the blocking portion, and the second modeling piece is rotated downward by its own weight to form an open mouth with the first modeling piece.

The present invention has obvious advantages and beneficial effects over the prior art. Specifically, it can be seen from the above technical solutions that the present invention mainly realizes skillfully the open and close of a toy product by means of squeezing through particular structure designs of the hollow soft shell, first modeling piece and second modeling piece; in a normal (no squeeze) state, the top wall is arched downward, the bottom of the first modeling piece is hidden in the accommodation concave chamber, the second modeling piece is supported by the blocking portion, and the second modeling piece is closed with the first modeling piece, capable of forming a doll head retracted, and the mouth thereof closed; while in a squeeze state, the top wall is arched upward, the second modeling piece is exposed upward with the first modeling piece, the second modeling piece is not supported by the blocking portion any more and rotated downward by its own weight so as to form an open mouth with the first modeling piece, capable of forming the doll projected outward to open the mouth suddenly. It is obviously that the present invention is novel in structure, interesting, energetic and easy to be operated and controlled. In addition, the toy of the present invention is easy to be produced and manufactured because of the simple structure thereof, very stable in use, and suitable for the promotion, production and application so as to meet entertainment, teaching, trick or other needs.

BRIEF DESCRIPTION OF THE DRAWINGS

In order to more clearly illustrate the structural features, the technical means and the attainable specific objects and functions of the present invention, the present invention will be described in more detail in conjunction with the accompanying drawings and the specific embodiment.

DETAILED DESCRIPTION OF THE PREFERRED EMBODIMENTS

Figure 1:
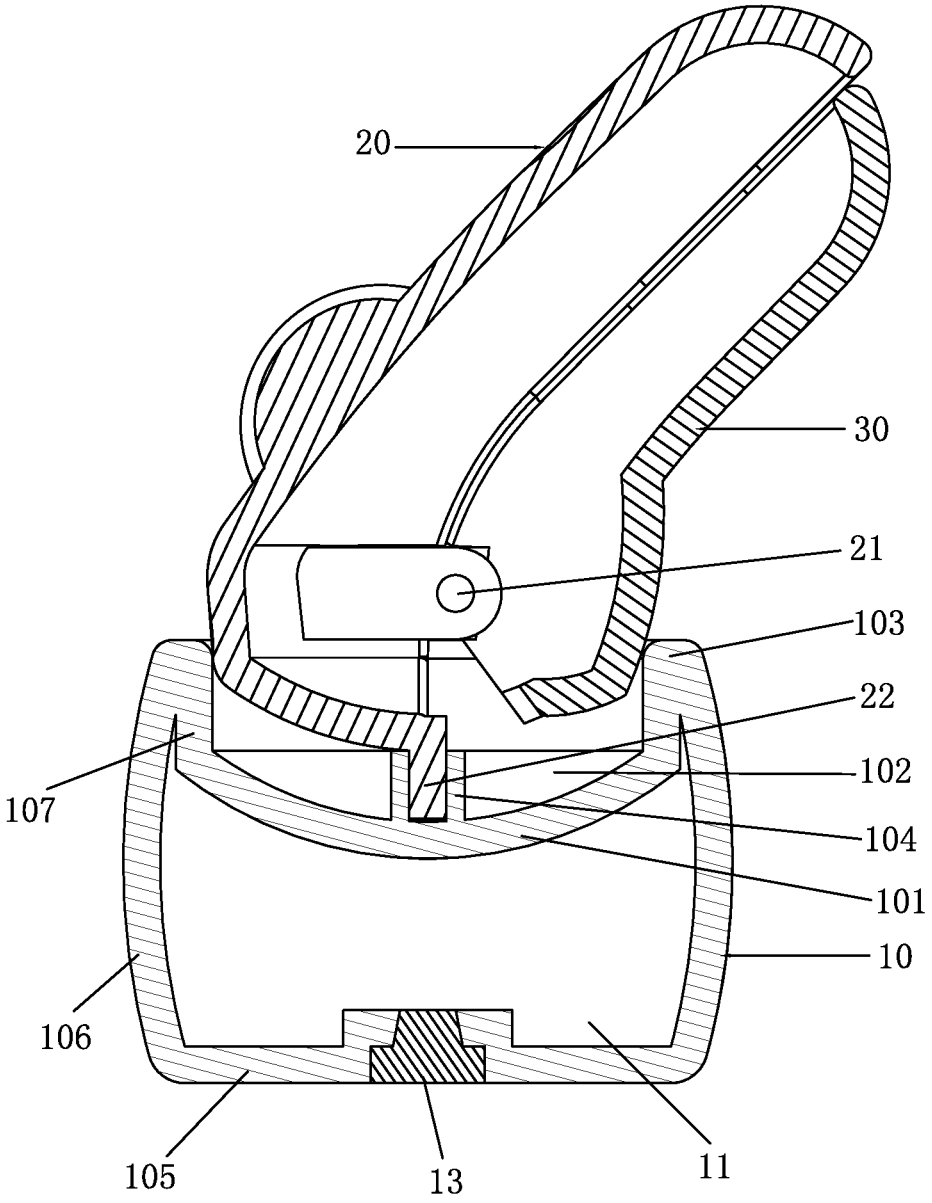
FIG. 1 is a schematically cross-sectional view of a toy of a preferred embodiment of the present invention in a normal (no squeeze) state.
Figure 2:
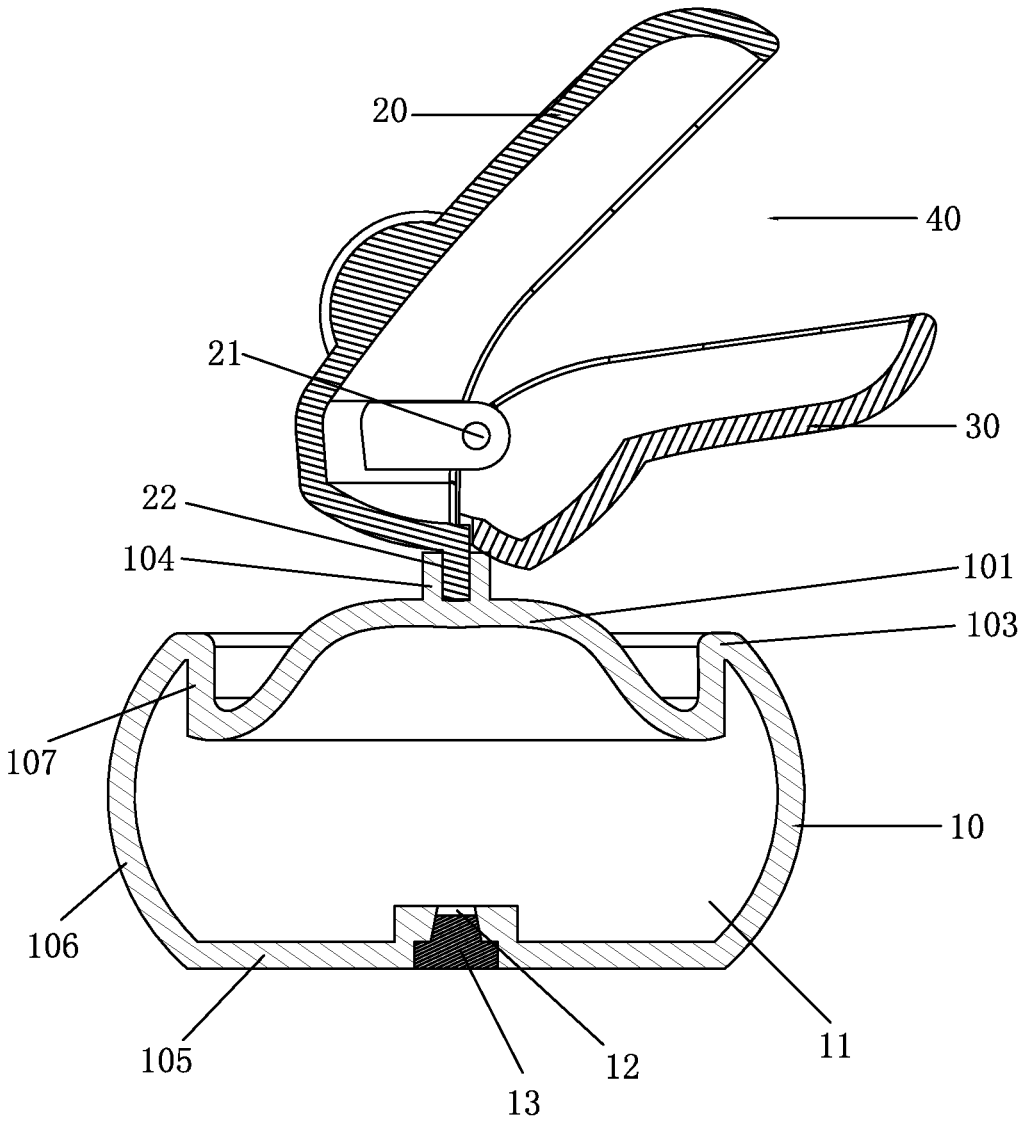
FIG. 2 is a schematically cross-sectional view of the toy of the embodiment of the present invention in a squeeze state.

Referring to FIGS. 1 and 2, in a preferred embodiment according to the present invention, a toy includes a hollow soft plastic shell 10 deformable by means of squeezing, a first modeling piece 20 configured on the hollow soft plastic shell 10, and a second modeling piece 30 coupled pivotally to the first modeling piece 20. Preferably, the hollow soft plastic shell 10 is a vinyl shell, and the first modeling piece 20 and second modeling piece 30 respectively are a plastic piece. Naturally, the materials mentioned above are not so limited, other materials may be used. The first modeling piece 20 and second modeling piece 30 are generally formed into an animal head shape, for example, a upper jaw and head are configured on the first modeling piece 20, and the second modeling piece 30 has a lower jaw.

In the embodiment, the first modeling piece 20 and second modeling piece 30 are respectively extended obliquely upward, with the first modeling piece 20 being positioned on he upper side of the second modeling piece 30, where the second modeling piece 30 can be rotated up and down relatively to the first modeling piece 20; here, a levelly-extended pivot shaft 21 is configured on the first modeling piece 20, a pivot hole is opened on the second modeling piece 30, and the pivot hole is put around the pivot shaft 21, thereby the second modeling piece 30 can be rotated up and down around the pivot shaft 21.

An air-filled chamber 11 is defined inside the hollow soft plastic shell 10, an air filling hole 12 in communication with the air-filled chamber 11 is opened on the hollow soft plastic shell 10, and a sealing plug 13 is configured inside the air filling hole 12. Furthermore, the hollow soft plastic shell 10 has a top wall 101 arched downward, the upper side thereof is formed with an accommodation concave chamber 102, and a blocking portion adapted to limit the second modeling piece 30 is further configured on the hollow soft plastic shell 10; the first modeling element 20 is in connection with the top wall 101, the outer surface of which is projected upward with a connection convex portion 104 on which the bottom of the first modeling piece 20 is installed, and the connection convex portion 104 is preferably configured on the center of the top wall 101, which facilitates keeping balance after squeeze. In the embodiment, a connection hole is concaved downward from the top end of the connection convex portion 104, a connection column 22 is configured on the bottom of the first modeling piece 20, and the connection column 22 is inserted in the connection hole, being very convenient in the assembly. Furthermore, the hollow soft plastic shell 10 further has a bottom wall 105 and peripheral wall 106 integrated with the bottom wall 105, the top end of the peripheral wall 106 is in connection with an annular flange 107 folded and extended downward, the peripheral edge of the top wall 101 is integrated with the bottom edge of the annular flange 107, and the junction of the annular flange 107 and peripheral wall 106 is formed into the blocking portion 103 mentioned above.

In a normal (no squeeze) state, as FIG. 1 shows, the top wall 101 is arched downward, while the bottom of the first modeling piece 20 is hidden in the accommodation concave chamber 102, the second modeling piece 30 being subject to a support force directed to the first modeling piece 20 exerted by the blocking portion 103 such that the second modeling piece 30 is closed with the first modeling piece 20. In addition, the blocking portion 103 is positioned higher than the bottom of the first modeling piece 20, and the pivot shaft 21 the blocking portion 103.

Furthermore, in a squeeze state, as FIG. 2 shows, the top wall 101 is arched upward, while the second modeling piece 30 is exposed upward together with the first modeling piece 20, the second modeling piece 30 will be separated from the blocking portion 103 and not supported thereby such that the second modeling piece 30 is rotated downward by its own weight, resulting in an open mouth 40 between it and the first modeling piece 20.

Furthermore, the air-filling hole 12 is opened on the bottom of the hollow soft plastic shell 10, which is a stepped hole structure small inside large outside, where a thickening portion is projected from the inner bottom face of the hollow soft plastic shell 10 at a position corresponding to the air filling hole 12, and the air filling hole 12 is passed upward through the thickening portion; the vertical section of the sealing plug 13 is formed into a "凸"-shaped structure, the bottom end face of which is kept flush with the bottom end face of the hollow soft plastic shell 10.

To sum up, the present invention mainly realizes skillfully the open and close of a toy product by means of squeezing through particular structure designs of the hollow soft shell, first modeling piece and second modeling piece; in a normal (no squeeze) state, the top wall is arched downward, the bottom of the first modeling piece is hidden in the accommodation concave chamber, the second modeling piece is supported by the blocking portion, and the second modeling piece is closed with the first modeling piece, capable of forming a doll head retracted, and the mouth thereof closed; while in a squeeze state, the top wall is arched upward, the second modeling piece is exposed upward with the first modeling piece, the second modeling piece is not supported by the blocking portion any more and rotated downward by its own weight so as to form an open mouth with the first modeling piece, capable of forming the doll projected outward to open the mouth suddenly. It is obviously that the present invention is novel in structure, interesting, energetic and easy to be operated and controlled. In addition the toy of the present invention is easy to be produced and manufactured because of the simple structure thereof, very stable in use, and suitable for the promotion, production and application so as to meet entertainment, teaching, trick or other needs.

I claim:

1. A toy, comprising a hollow soft plastic shell deformable by means of squeezing, a first modeling piece configured on said hollow soft plastic shell, and a second modeling piece coupled pivotally to said first modeling piece, said second modeling piece rotatable up and down relatively to said first modeling piece, wherein an air-filled chamber is defined inside said hollow soft plastic shell, an air filling hole in communication with said air-filled chamber is opened on said hollow soft plastic shell, and a sealing plug is inserted in said air filling hole; said hollow soft plastic shell has a top wall arched downward, an accommodation concave chamber is formed on an upper side of said top wall of said hollow soft plastic shell, and a blocking portion adapted to limit said second modeling piece is further configured on said hollow soft plastic shell; said first modeling piece is in connection with top wall;

wherein said hollow soft plastic shell further has a bottom wall and peripheral wall integrated with said bottom wall, a top end of said peripheral wall is in connection with an annular flange folded and extended downward, a peripheral edge of said top wall is integrated with a bottom end of said annular flange, and a junction of said annular flange and peripheral wall is formed into said blocking portion to circumferentially surround said top wall;

wherein said first modeling piece has a bottom that is mounted to a portion of said top wall and is movable in unison with said top wall;

wherein in a normal state, said top wall is arched downward and shows an arched-down configuration and said blocking portion that circumferentially surrounds said top wall defines, in combination of the arched-down configuration of said top wall, said accommodation concave chamber, such that a portion of the bottom of said first modeling piece is received and hidden in said accommodation concave chamber and said second modeling piece is moved into contact engagement with said blocking portion to receive a support force facing toward said first modeling piece exerted by said blocking portion to have said second modeling piece closed with said first modeling piece; and in a squeeze state, said top wall is ached upward as being changed from the arched-down configuration of the normal state into an arch-up configuration so as to cause the portion of said top wall to which the bottom of said first modeling piece is mounted to raise to a location higher than said blocking portion, so that said second modeling piece that is pivotally coupled to said first modeling piece is exposed upward together with the bottom of said first modeling piece to make said second modeling piece separated from and thus not supported by said blocking portion, and allowing said second modeling piece to rotate downward by its own weight to form an open mouth with said first modeling piece;

wherein said top wall is deformable between the arched-down configuration and the arched-up configuration to have the portion of said top wall to which the bottom of said first modeling piece is mounted to move between a concealed position, where said portion of said top wall is located in said accommodation concave space defined the arched-down configuration of said top wall and said blocking portion and is concealed by the blocking portion so as to set said first and second modeling pieces partly in said accommodation concave space to have said second modeling piece closed to said first modeling piece as being set in contact engagement with said blocking portion and an exposed position corresponding to the arched-up configuration where said portion of said top wall is moved to a location higher than said blocking portion so as to have said top wall partly out of the said accommodation concave space and set said first and second modeling piece away from said blocking portion to release the support force from said blocking portion whereby said second modeling piece moves away from said first modeling piece to form the open mouth, wherein the portion of said top wall to which the bottom of said first modeling piece is mounted is movable with respect to said blocking portion that is mounted to the peripheral edge of said top wall between said concealed position and said exposed position.

2. The toy according to claim 1, wherein a connection convex portion is projected upward from an outer surface of said top wall, and the bottom of said first modeling piece is configured on said connection convex portion.

3. The toy according to claim 2, wherein said connection convex portion is configured on a center of said top wall.

4. The toy according to claim 2, wherein a connection hole is concaved downward from a top end of said connection convex portion, a connection column is configured on the bottom of said first modeling piece, and said connection column is inserted in said connection hole.

5. The toy according to claim 1, wherein said first modeling piece and second modeling piece both are extended upward obliquely, and said first modeling piece is positioned on an upper side of said second modeling piece.

6. The toy according to claim 1, wherein a levelly extended pivot shaft is configured on said first modeling piece, a pivot hole is opened on said second modeling piece, said pivot hole is put around said pivot shaft movably, and said second modeling piece is rotatable up and down around said pivot shaft.

7. The toy according to claim 6, wherein in said normal state, said blocking portion is positioned higher than a bottom of said first modeling piece, and said pivot shaft is positioned higher than said blocking portion.

8. The toy according to claim 1, wherein said air filling hole is opened on a bottom of said hollow soft plastic shell, said air filling hole is formed into a stepped structure small inside large outside, an inner bottom face of said hollow soft plastic shell is projected with a thickening portion corresponding to said air filling hole, and said air filling hole is passed upward through said thickening portion; a vertical section of said sealing plug is formed into an inverted T-shaped structure, and a bottom end face of said sealing plug is kept flush with a bottom end face of said hollow soft plastic shell.

9. The toy according to claim 1, wherein said hollow soft plastic shell is a vinyl shell, and said first modeling piece and second modeling piece respectively are a plastic piece.

* * * * *